United States Patent [19]

Mangalick

[11] 4,052,199

[45] Oct. 4, 1977

[54] GAS INJECTION METHOD

[75] Inventor: Mahesh C. Mangalick, Solon, Ohio

[73] Assignee: The Carborundum Company, Niagara Falls, N.Y.

[21] Appl. No.: 597,806

[22] Filed: July 21, 1975

[51] Int. Cl.[2] ..... C22B 21/00

[52] U.S. Cl. ..... 75/68 R; 75/93 AC; 75/93 E

[58] Field of Search ..... 75/68 R, 93 R, 93 AC, 75/93 E

[56] References Cited

U.S. PATENT DOCUMENTS

| | | | |
|---|---|---|---|
| 2,528,208 | 10/1950 | Bonsack et al. | 75/68 R |
| 2,821,472 | 1/1958 | Peterson et al. | 75/68 R |
| 3,839,019 | 10/1974 | Bruno et al. | 75/68 R |

FOREIGN PATENT DOCUMENTS

| | | | |
|---|---|---|---|
| 1,400,556 | 7/1975 | United Kingdom | 75/46 |

*Primary Examiner*—M. J. Andrews
*Attorney, Agent, or Firm*—David E. Dougherty; Raymond W. Green

[57] ABSTRACT

Gas is injected into molten metal, such as aluminum, to purify the molten metal either of dissolved gases (degassing), or of dissolved solids such as magnesium ("demagging"). The apparatus for accomplishing this injection contains two metallic bath chambers, the molten metal being transferred from one chamber to the other through a conduit. A gas injection conduit is connected to the metal transfer conduit at a location submerged within the first metallic bath chamber from which metal is transferred to the second chamber, and the gas to be injected is introduced through this gas injection conduit into a location submerged within the first metallic bath chamber.

14 Claims, 1 Drawing Figure

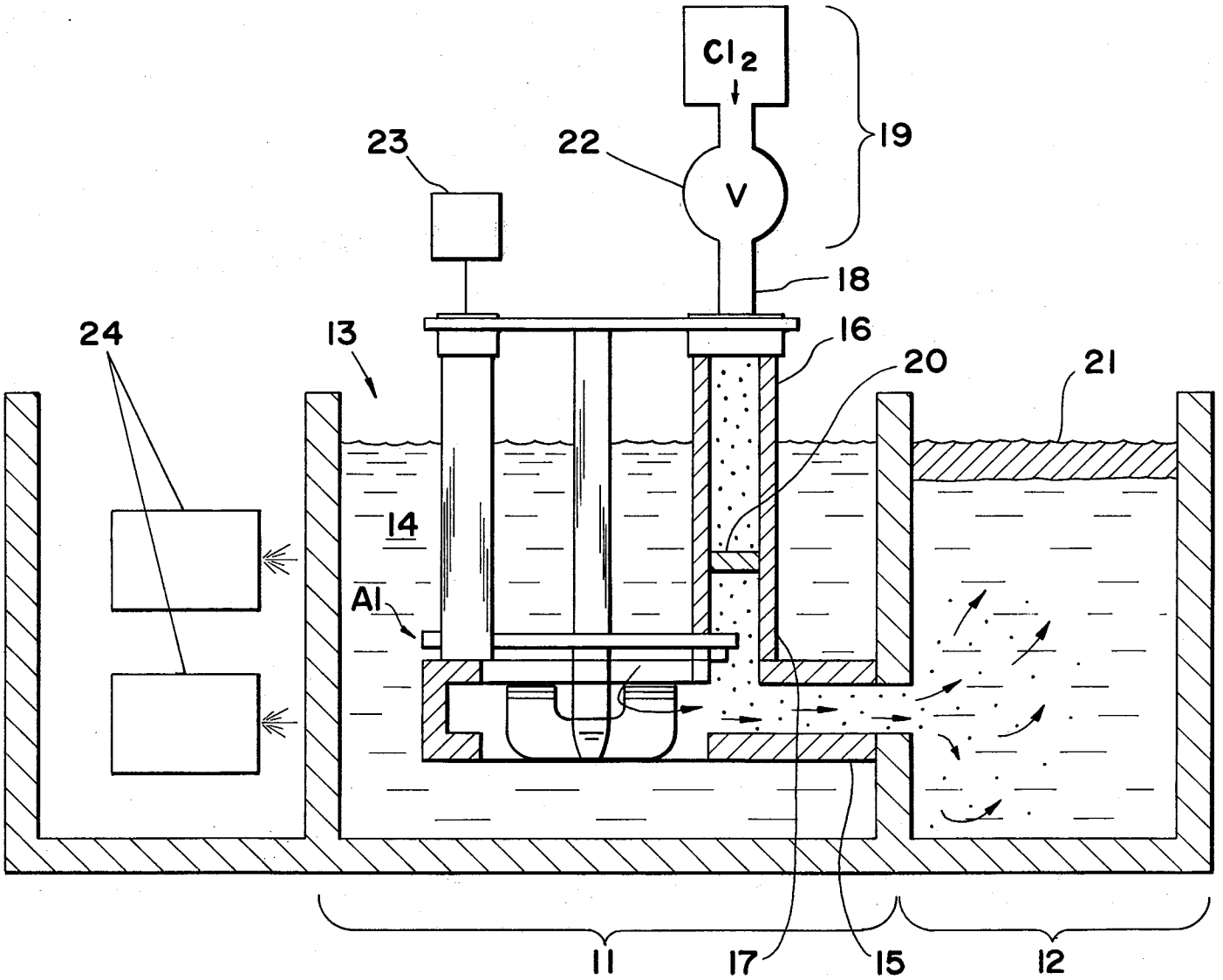
Cl2
V
19
18
16
20
21
22
23
13
14
Al
24
12
15
17
11

GAS INJECTION METHOD

BACKGROUND OF THE INVENTION

In the purification of molten metals, particularly aluminum, it is frequently desired to remove dissolved gases such as hydrogen or dissolved metals, chiefly magnesium. The removal of dissolved gas is known as "degassing", while the removal of magnesium is known as "demagging". Further details concerning the demagging of aluminum are described in an article by M. C. Mangalick, entitled "Demagging Aluminum" which appeared in Die Casting Engineer, January-February, 1974, the disclosure of which is incorporated by reference.

For demagging aluminum, chlorine gas is usually used since magnesium chloride has a more negative free energy of formation than aluminum chloride, so that the chlorine will react preferentially with the magnesium instead of forming aluminum trichloride. Kinetic factors of various prior art methods do not permit the ultimate formation of magnesium chloride. Thus, aluminum trichloride and free chlorine can be emitted into the atmosphere according to the prior art methods. Both of these compounds are air pollutants.

Earlier practices include capturing of pollutants in an enclosed cover connected to a suction generating water treatment plant. Each pound of magnesium reacts with about 2.95 lbs. of chlorine to form $MgCl_2$, and "demagging efficiency" is therefore defined as 2.95 divided by the actual amount of chlorine used to remove 1 lb. of magnesium. The efficiency of this method of chlorine removal has been less than 75%, and in the worst cases has been 0 in cases of low magnesium content.

Another method of purification of aluminum is described in Derham et al, U.S. Pat. No. 3,650,730, wherein a flux containing a double salt of chlorine, such as cryolite, is used as a chloridizing agent, in removing the magnesium or other impurity. The apparatus of the Derham patent requires maintenance and continuous monitoring of flux composition and thickness, among other variables.

Another form of apparatus for refining molten aluminum is described by M. J. Bruno et al, in U.S. Pat. No. 3,767,382. According to this apparatus, gas is introduced through a rotating hollow shaft and impeller arrangement which presents the problem of maintaining a leak-proof gas-rotating shaft junction.

It is therefore an object of this invention to provide a new and improved method of introducing gas into molten metal such as aluminum, in a manner which permits greater efficiency in the use of introduced gas, and greater control over the escape of the introduced gas into the atmosphere.

SUMMARY OF THE INVENTION

There is, accordingly, provided by the present invention a gas injection apparatus for introducing gas into molten metal, comprising a first metallic bath chamber; a second metallic bath chamber; means for flowing metal from the first metallic bath chamber to the second metallic bath chamber, through a metal transfer conduit, the metal transfer conduit being at least partially submerged in the first metallic bath chamber; a two-ended gas injection conduit having one end submerged within the first metallic bath chamber, the submerged end of the gas injection conduit connected to the metal transfer conduit, the gas injection conduit being so constructed and so arranged that the metal of the first metallic bath chamber is flowable past the first end of the gas injection conduit, the gas injection conduit having an unsubmerged end opposite the surmerged end of the gas injection conduit; and means for providing gas to be introduced into the molten metal into the unsubmerged end of the gas injection conduit.

According to another aspect of the present invention, there is provided a process for introducing gas into a molten metal, comprising the steps of flowing molten metal from a first metallic bath chamber through a metal transfer conduit to a second metallic bath chamber, and introducing a gas to be injected into the molten metal into a two-ended gas injection conduit, one end of which is submerged within the first metallic bath chamber and connected to the metal transfer conduit between the first and second metallic bath chambers.

BRIEF DESCRIPTION OF THE DRAWING

The single FIGURE of drawing is a schematic cross-sectional view of the gas injection apparatus of the present invention.

DETAILED DESCRIPTION

With further reference to the drawing, there is illustrated in vertical cross-section a schematic representation of the gas injection apparatus of the present invention. The apparatus comprises generally a first metallic bath chamber 11 and a second metallic bath chamber 12. There is provided also means generally indicated at 13 for flowing metal 14 from the first metallic bath chamber 11 through a metal transfer conduit 15, the metal transfer conduit 15 being at least partially submerged in the first metallic bath chamber 11. There is also provided a two-ended gas injection conduit 16 having one end 17 submerged within the first metallic bath chamber 11, the submerged end 17 of the gas injection conduit 16 being connected to the metal transfer conduit 15, the gas injection conduit 16 being so constructed and arranged that the metal 14 of the first metallic bath chamber 11 is flowable past the submerged end 17 of the gas injection conduit 16, the gas injection conduit having an unsubmerged end 18 opposite the submerged end 17 of the gas injection conduit 16.

There is also provided means, generally, indicated at 19, for providing gas to be introduced into the molten metal, into the unsubmerged end 18 of the gas injection conduit 16.

Means 13 for flowing metal 14 between the metallic bath chambers 11 and 12 preferably comprises a molten metal pump, the general details of which are shown in V. D. Sweeney et al U.S. Pat. No. 2,948,524, the disclosure of which is incorporated herein by reference.

For some applications it is preferred, but by no means essential, that the gas injection conduit 16 be provided with a chemically resistant, gas permeable, metal impermeable, plug 20 within the submerged end 17 of the gas injection conduit 16. If used, the preferred material for plug 20 is glass-bonded alumina, such as that available from The Carborundum Company under the trademark Aloxite.

The chief utility of the present invention is the removal of dissolved gas or magnesium from aluminum. Depending on the removal to be accomplished, the gas is selected accordingly. If it is desired to remove magnesium, for example, a reactive gas such as fluorine or preferably chlorine will be utilized. On the other hand, if it is intended to degas the aluminum, an inert gas such as nitrogen or argon can also be used. In the first case, the chlorine or fluorine reacts with the magnesium impurity to form magnesium halide. In the second case, the hydrogen dissolves in the nitrogen, argon, chlorine or aluminum chloride gas bubble, which merely passes through the aluminum, and bubbles out the top of the aluminum carrying the previously dissolved hydrogen or other impurity gas with it.

In the situation where chlorine is utilized to remove magnesium from the aluminum, it forms magnesium chloride which has a melting point of 712° C and, because of its lower density (2.325 g/cc as compared to 2.70 g/cc for aluminum), it rises to the surface of the melt, from which it can be removed. Aluminum chloride on the other hand sublimes at 178° C. It is therefore possible, under some conditions of operation, for the chlorine (or fluorine) and possibly aluminum tri-chloride to escape from the aluminum of the second metallic bath chamber 12, prior to reacting with metallic aluminum alloy to form magnesium halide. To guard against this possibility it is preferred in some cases to provide a flux material 21 to cover the second metallic batch chamber 12. It is preferred that the flux material be a metallic salt or mixture of metallic salts. Particular salts which are preferred are sodium chloride, potassium chloride, cryolite and mixtures thereof. For example, the flux material may be sodium chloride, potassium chloride, or a mixture of sodium chloride and potassium chloride. An example of a flux material which has been used successfully is 47.5% by weight sodium chloride, 47.5% by weight potassium chloride and 5% by weight cryolite, commonly known as open hearth flux.

If the gas injection apparatus of the present invention is used for reacting a reactive gas with an impurity in the molten metal, it may be desirable to include means, such as valve 22 and control 23 for controlling the rates of flow of molten metal through the metal transfer conduit, and of introduction of gas into the gas injection conduit. The reason why it would be desired to control these rates, for example, would be to prevent excess chlorine from entering the metallic bath chambers 11 and 12, in excess of the amount which could react with the magnesium in the aluminum, so that the chlorine would escape into the atmosphere, particularly if no flux material 21 were employed.

In operation, the gas injection apparatus of the present invention is utilized for introducng gas into a molten metal by flowing molten metal 14 from the first metallic bath chamber 11 through metal transfer conduit 15 to second metallic bath chamber 12, and introducing a gas such as chlorine, fluorine, nitrogen or argon, which is to be injected into the molten metal, into the two-ended gas injection conduit 16, one end 17 of which is submerged within first metallic bath chamber 11 and connected to the metal transfer conduit 15 between the first and second metallic bath chambers 11 and 12. The preferred material for the metal transfer conduit 15 and gas injection conduit 16, as well as for means 13 for flowing the metal, is graphite. Perhaps the most common use of the present invention would be to demagg aluminum containing from about 1 to about 4% by weight magnesium. In so doing, the magnesium content would be reduced to an acceptable level, for example 0.1% by weight. As indicated above, valve 22 and control 23 are useful to control the relative rate of flow of molten metal and gas in proportion to the amount of magnesium in the aluminum. In particular, the rate of introduction of chlorine should be held at 2.95 lbs. chlorine per pound of magnesium removed from the aluminum which is flowed through the metal transfer conduit 15, in order to insure complete reaction of the chlorine and therefore no chlorine escaping into the atmosphere. Flow rates of chlorine can vary for example from about 20 to about 250 lbs/hr. at an aluminum flow rate of about 4,000 lbs/min.

The apparatus of the present invention has equal applicability, of course, in removing dissolved gases from molten metals, as well as providing reactants to react with dissolved impurities such as magnesium. In such a case the metal which is flowed through the metal transfer conduit can be, for example, aluminum containing dissolved gases. The most likely dissolved gas to be removed is hydrogen, and the favored gases to be introduced into the molten metal in accordance with the process of the present invention for removing such dissolved gases are argon or nitrogen. For such purposes, the rate of introduction of gas into the gas injection conduit can range from about 5 to about 50 lbs/hr., preferably about 20 lbs/hr.

In conjunction with the apparatus illustrated in FIG. 1, it is necessary to use means for melting the metal within the metallic gas chambers 11 and 12. This is shown in the drawing schematically as burners 24. In practice, it is preferred to use a reverberatory furnace for this purpose.

If desired, the metal from metallic bath chamber 12, which has a lower impurity content than the metal in metallic bath chamber 11, can be recycled through metallic bath chamber 11 indefinitely, or passed repeatedly through separate purification operations, in order to successively reduce the impurity content to an acceptable level.

The invention will now be illustrated with an Example.

A gas injection apparatus as illustrated in the drawing and described above, provided with a 110,000 lbs. capacity reverberatory furnace, was used to reduce magnesium content in aluminum. In each of runs 1 through 3, the magnesium level varied from 0.13 to 0.2, as indicated in Table I. The rate of introduction of chlorine varied from 120 to 200 lbs/hr, and the pump was operated so as to furnish about 4,000 lbs/min of molten aluminum passing through metal transfer conduit 15. The temperatures of the melts were maintained between 1460 and 1490° F, the exact temperature being shown in Table I. The reaction conditions for the various runs illustrated were such that the entire amount of chlorine was consumed. The magnesium content of the purified aluminum taken from the second metallic bath chamber is indicated in Table I.

TABLE I

| Run | Initial Mg Content, Weight % | Chlorine Rate, Pounds Per Hour | Temp. ° F | Final Mg Content, Weight % |
|---|---|---|---|---|
| 1 | 0.2 | 130–165 | 1460–1485 | 0.13 |
| 2 | 0.145 | 125–200 | 1485 | 0.107 |
| 3 | 0.13 | 120 | 1490 | 0.095 |

At the 120 lbs/hr. (2 lbs/min.) chlorine injection rate, (2.00/2.95), or 0.68 lbs/min. of magnesium are removed from the aluminum. If the pumping rate is 4,000 lbs/min., the drop in magnesium content should therefore be about 0.107%, which was found to be so.

The operating conditions can be varied as desired. For example, when the depth of metal is low, the flow rate of metal should be high by operating the pump at a greater speed. to throw the chlorine or other gases further away in the horizontal direction from the inlet of the metal transfer conduit 15 into metallic bath chamber 12. Similarly if the magnesium content is low the chlorine injection rate should be kept low so that 100% utilization of the chlorine is achieved, to prevent pollution from escaping chlorine gas.

A further advantage of the present invention over previous methods is the capacity to inject gas simultaneously with charging and melting operations for the furnace. In addition to removing gases and dissolved metallic material, the gas injection apparatus of the present invention is easily adaptable to removal of inclusions (solid particles) by an appropriate filter mechanism attached to the metal transfer conduit, for example at point of entry into metallic bath chamber 12. In addition to magnesium, of course other impurities such as dissolved sodium and the like can be removed by an appropriate choice of injected gas.

I claim:

1. A process for introducing gas into molten metal in an apparatus comprising a. a first metallic bath chamber;

b. a second metallic bath chamber;

c. means for flowing metal from the first metallic bath chamber to the second metallic bath chamber, through a metal transfer conduit, said metal transfer conduit being at least partially submerged in the first metallic bath chamber;

d. a two-ended gas injection conduit having one end submerged within the first metallic bath chamber, the submerged end of the gas injection conduit being connected to the metal transfer conduit, the gas injection conduit being so constructed and arranged that the metal of the first metallic bath chamber is flowable past the submerged end of the gas injection conduit so as to contact the gas within the gas injection conduit and permit passage of the gas from the gas injection conduit to the metal transfer conduit, the gas injection conduit having an unsubmerged end opposite the submerged end of the gas injection conduit; and e. means for providing gas to be introduced into the molten metal into the unsubmerged end of the gas injection conduit, comprising the steps of:

1. introducing a gas to be injected into the molten metal, into the two-ended gas injection conduit, one end of which is submerged within the first metallic bath chamber and connected to the metal transfer conduit between the first and second metallic bath chambers; while 2. flowing the molten metal from the first metallic bath chamber through the metal transfer conduit to the second metallic bath chamber, past the submerged end of the gas injection conduit connected so as to connect the gas within the gas injection conduit and permit passage of the gas from the gas injection conduit to the metal transfer conduit; and 3. passing the gas from the gas injection conduit into the metal transfer conduit and into the flowing molten metal in the metal transfer conduit.

2. A process according to claim 1, wherein the metal which is flowed through the metal transfer conduit is aluminum containing from about 1 to about 4% by weight magnesium.

3. A process according to claim 2, wherein the gas is chlorine.

4. A process according to claim 2, wherein the gas is fluorine.

5. A process according to claim 1, wherein the metal is aluminum and the gas is nitrogen.

6. A process according to claim 1, wherein the metal is aluminum and the gas is argon.

7. A process according to claim 3, wherein the relative rate of flow of molten metal and gas are controlled in proportion to the amount of magnesium in the aluminum.

8. A process according to claim 3, wherein the introduction of chlorine is 2.95 lbs. chlorine per pound of magnesium removed from the aluminum which is flowed through the metal transfer conduit.

9. A process according to claim 3, wherein the rate of introduction of chlorine ranges from about 20 to about 250 lbs/hr.

10. A process according to claim 3, wherein the rate of aluminum flow is about 4,000 lbs/min.

11. A process according to claim 1, wherein the metal which is flowed through the metal transfer conduit is aluminum containing dissolved gases.

12. A process according to claim 11, wherein the gas is chlorine, argon, nitrogen, or mixtures thereof.

13. A process according to claim 12, wherein the introduction of gas into the gas injection conduit ranges from about 5 to about 50 lbs/hr.

14. A process according to claim 13, wherein the gas is introduced into the gas injection conduit at a rate of about 20 lbs/hr.

* * * * *